US008091241B2

(12) United States Patent
Ouchi et al.

(10) Patent No.: US 8,091,241 B2
(45) Date of Patent: Jan. 10, 2012

(54) ELECTRIC HAIR REMOVER

(75) Inventors: Kazuyuki Ouchi, Hikone (JP); Hitoshi Ogawa, Inukami-gun (JP); Wei Wang, Omihachiman (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 516 days.

(21) Appl. No.: 12/277,485

(22) Filed: Nov. 25, 2008

(65) Prior Publication Data

US 2009/0163932 A1 Jun. 25, 2009

(30) Foreign Application Priority Data

Dec. 25, 2007 (JP) ..... 2007-332622

(51) Int. Cl.
*B26B 19/02* (2006.01)

(52) U.S. Cl. ..... 30/43.92; 30/47; 30/335; 30/531

(58) Field of Classification Search ..... 30/40, 41, 30/43.4–43.92, 47, 334, 335, 526, 527, 531, 30/FOR. 100, FOR. 104, DIG. 2
See application file for complete search history.

(56) References Cited

U.S. PATENT DOCUMENTS

| | | | | |
|---|---|---|---|---|
| 4,188,717 | A * | 2/1980 | Mansfield | 30/537 |
| 4,521,962 | A | 6/1985 | Van Natta | |
| 5,193,528 | A * | 3/1993 | Iwamoto et al. | 601/72 |
| 6,189,222 | B1 * | 2/2001 | Doyle | 30/531 |
| 2004/0107585 | A1 | 6/2004 | Helmrich | |
| 2005/0229398 | A1 | 10/2005 | Leventhal | |
| 2007/0044320 | A1 | 3/2007 | Fukutani et al. | |
| 2007/0261249 | A1 * | 11/2007 | Yamasaki et al. | 30/43.7 |
| 2007/0289144 | A1 | 12/2007 | Morisugi et al. | |
| 2008/0208190 | A1 | 8/2008 | Hashiguchi et al. | |
| 2008/0294176 | A1 | 11/2008 | Hashiguchi et al. | |
| 2011/0088268 | A1 * | 4/2011 | Marut | 30/526 |

FOREIGN PATENT DOCUMENTS

| | | | |
|---|---|---|---|
| CA | 2443881 | | 4/2005 |
| JP | 60-91176 | * | 6/1985 |
| JP | 61-103472 | | 5/1986 |
| JP | 2007-105077 | | 4/2007 |

OTHER PUBLICATIONS

English language Abstract of JP 2007-105077, Apr. 26, 2007.

* cited by examiner

*Primary Examiner* — Edward Landrum
(74) *Attorney, Agent, or Firm* — Greenblum & Bernstein P.L.C.

(57) ABSTRACT

An electric hair remover, includes: a body part having a head end part in a longitudinal direction, a blade part for cutting hair being formed at the head end part; a holder part mounted to the body part in such a configuration as to slide along the longitudinal direction of the body part and to rotate.

8 Claims, 13 Drawing Sheets

ELECTRIC HAIR REMOVER

BACKGROUND OF THE INVENTION

1. Field of the Invention

The present invention relates to an electric hair remover (epilator) for removing hair.

2. Description of the Related Art

Conventionally, an electric hair remover such as electric razor has such a structure that a blade block for cutting hair is disposed at a head end of a body part which also serves as a holder part. A motor for driving the blade, a driver for transmitting the driving force of the motor and a battery block for driving the motor, and the like are received in the body part. Turning on (on-operation) a switch drives the motor, thereby moving the blade for removing hair.

On the other hand, Japanese Patent Application Laid-Open No. 2007-105077 (=JP2007105077) discloses a manual safety razor (referred to as "T-shaped trimmer for shaving eyebrows") which has such a structure that a body part is made bendable or telescopic. As such, the razor has a convenient configuration during operation by the user while the razor is made compact for storage (put in a receptacle) after the operation.

SUMMARY OF THE INVENTION

For receiving the motor, driver, battery block and the like in the body part, the above conventional electric hair remover, however, has difficulty in making the body part telescopic which also serves as a holder part. In other words, the body part of the conventional electric hair remover is fixed at a relatively short length, making it difficult to remove hair which is beyond the reach of hand or hard to reach.

It is therefore an object the present invention to provide an electric hair remover capable of improving usability during operation.

According to an aspect of the present invention, an electric hair remover, comprises: a body part having a head end part in a longitudinal direction, a blade part for cutting hair being formed at the head end part; a holder part mounted to the body part in such a configuration as to slide along the longitudinal direction of the body part and to rotate.

Other objects and features of the present invention will become understood from the following description with reference to the accompanying drawings.

DESCRIPTION OF THE PREFERRED EMBODIMENTS

In the following, an embodiment of the present invention will be described in detail with reference to the accompanying drawings.

For ease of understanding, the following description will contain various directional terms, such as right, left, upper, lower, forward, rearward and the like. However, such terms are to be understood with respect to only a drawing or drawings on which the corresponding part of element is illustrated.

In addition, it is noted that the drawings referred to hereinafter as illustrating the preferred embodiment of the present invention are not to scale and are schematic in nature and, therefore, should not be taken too literally. Nevertheless, the drawings illustrate the invention sufficiently to enable one skilled in the art to practice the invention.

FIG. 1 to FIG. 15 show an electric hair remover, according to an embodiment of the present invention.

Figure 1:
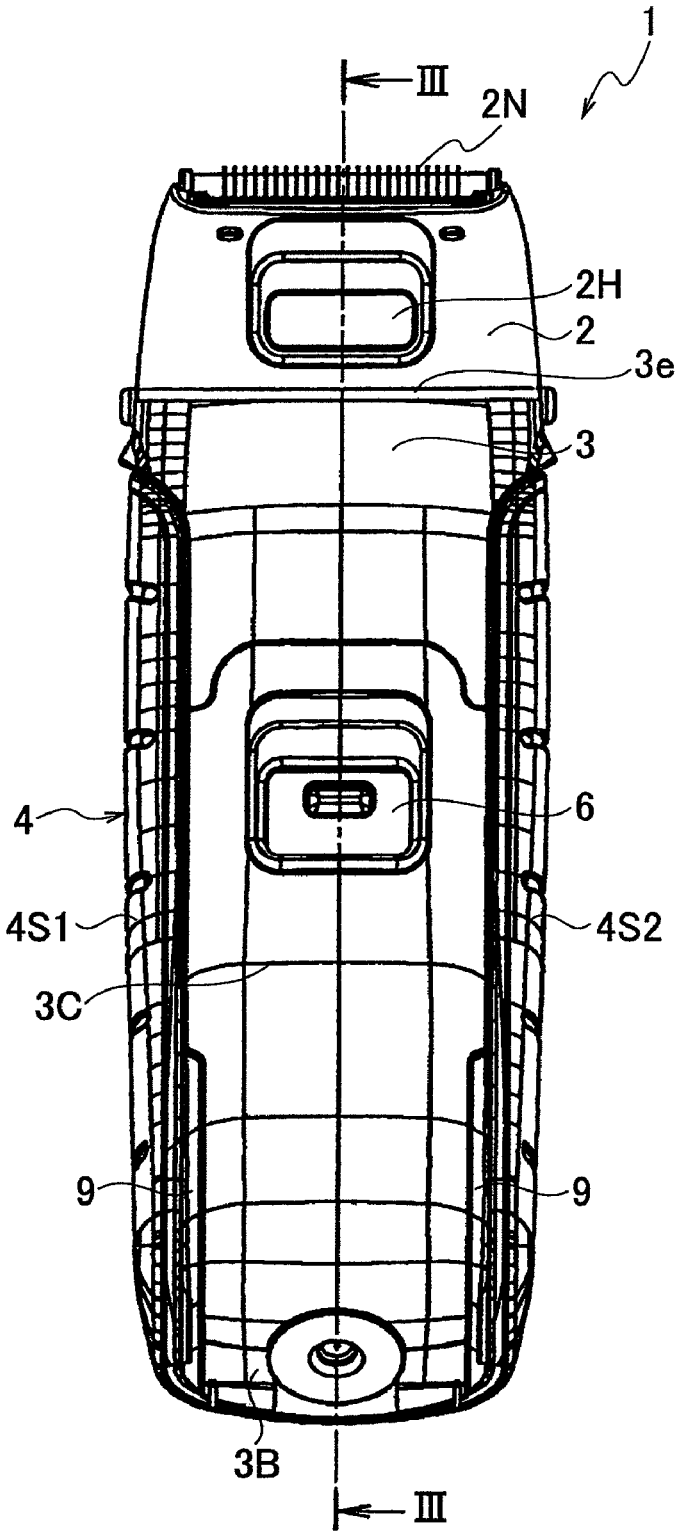
FIG. 1 is a front view of an electric hair remover, according to an embodiment of the present invention.

FIG. 1 is a front view of the electric hair remover.

Figure 2:
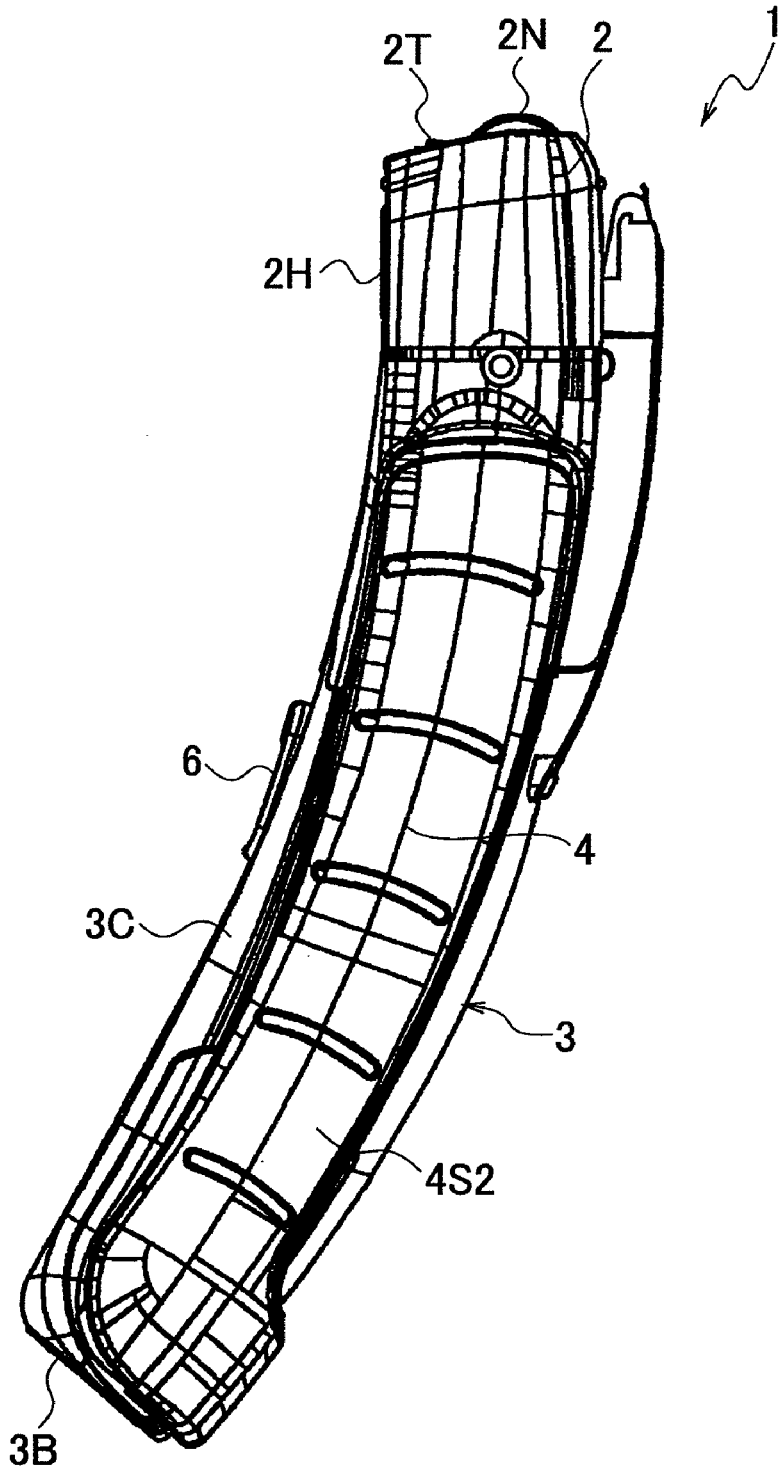
FIG. 2 is a side view of the electric hair remover, according to the embodiment of the present invention.

FIG. 2 is a side view of the electric hair remover.

Figure 3:
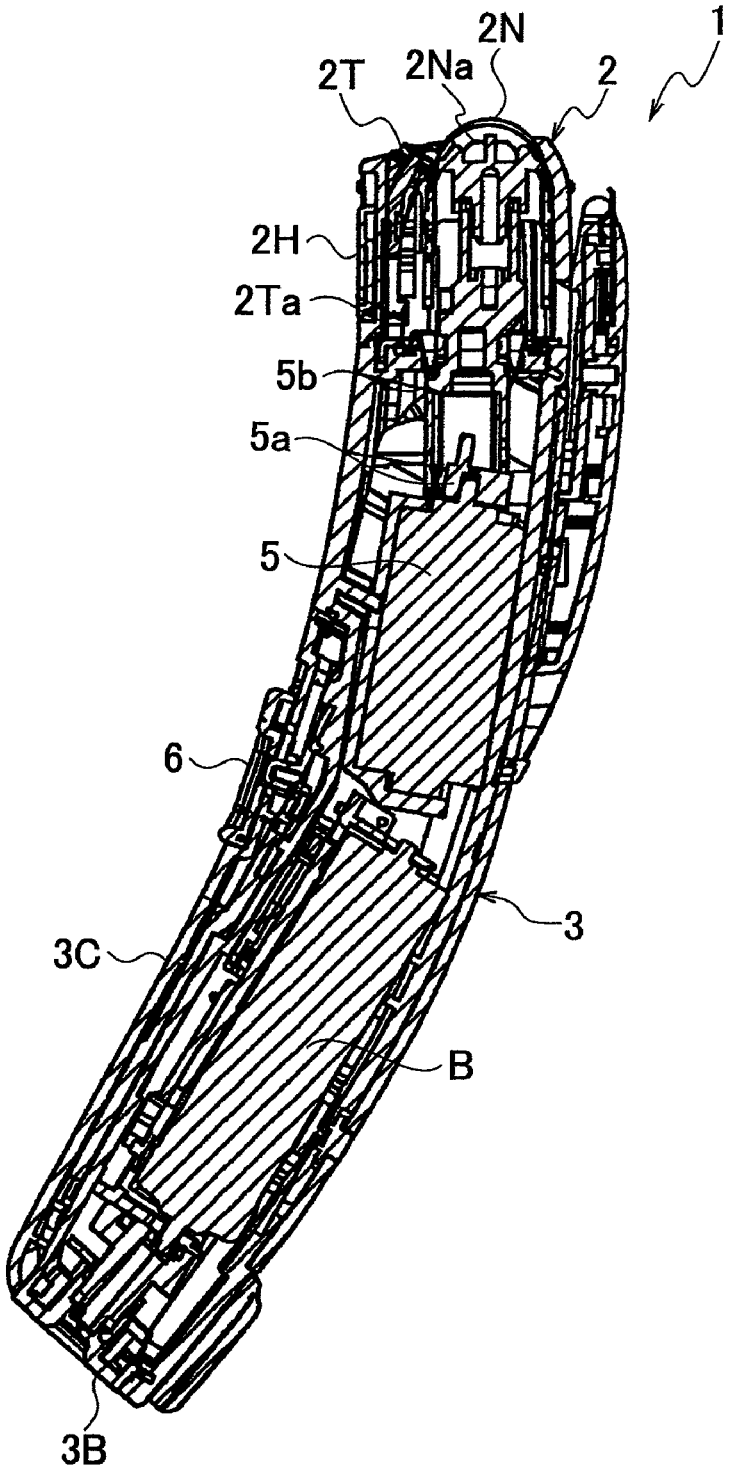
FIG. 3 is a cross sectional view taken along the line III-III in FIG. 1.

FIG. 3 is a cross sectional view taken along the line III-III in FIG. 1.

Figure 4:
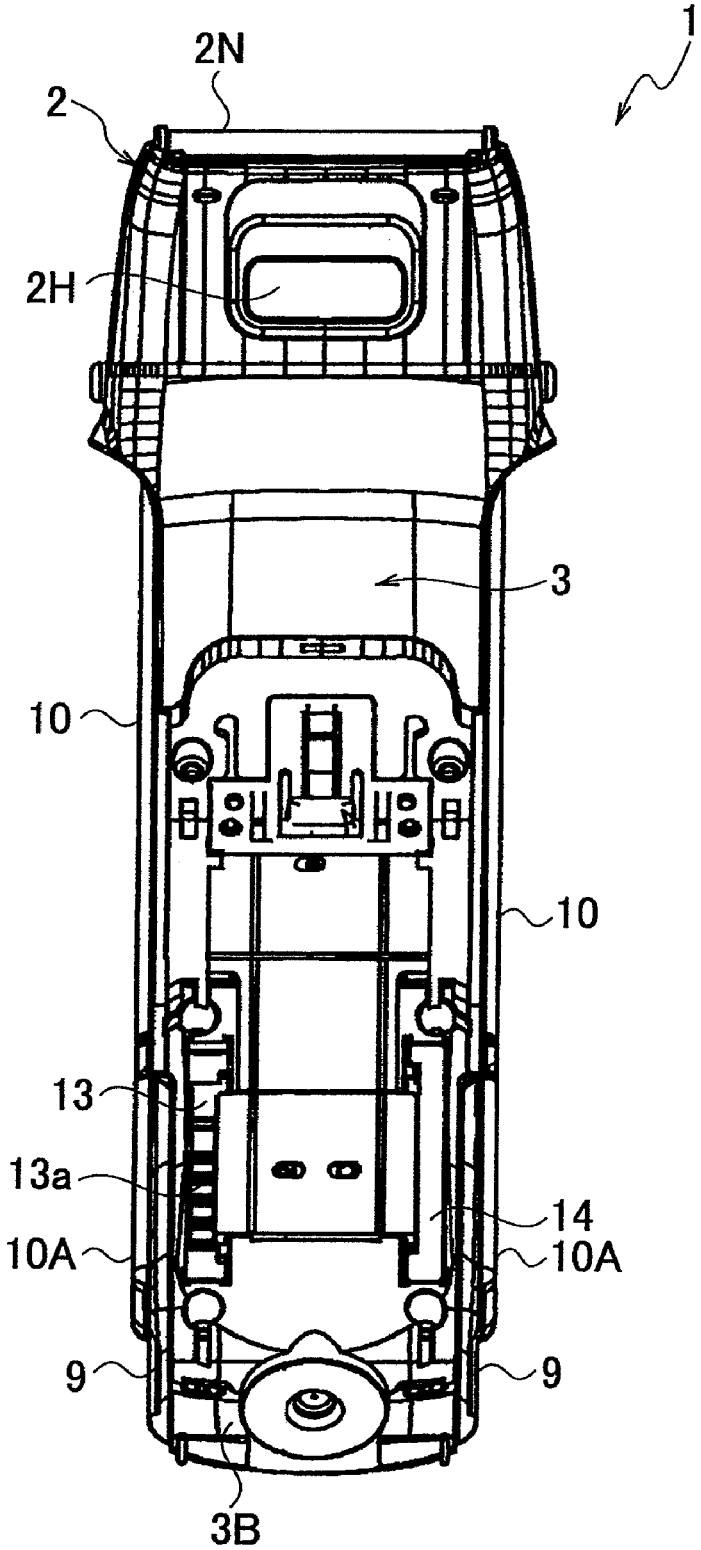
FIG. 4 is a front view of the electric hair remover, with a holder part and a front cover removed, according to the embodiment of the present invention.

FIG. 4 is a front view of the electric hair remover, with a holder part and a front cover removed.

Figure 5:
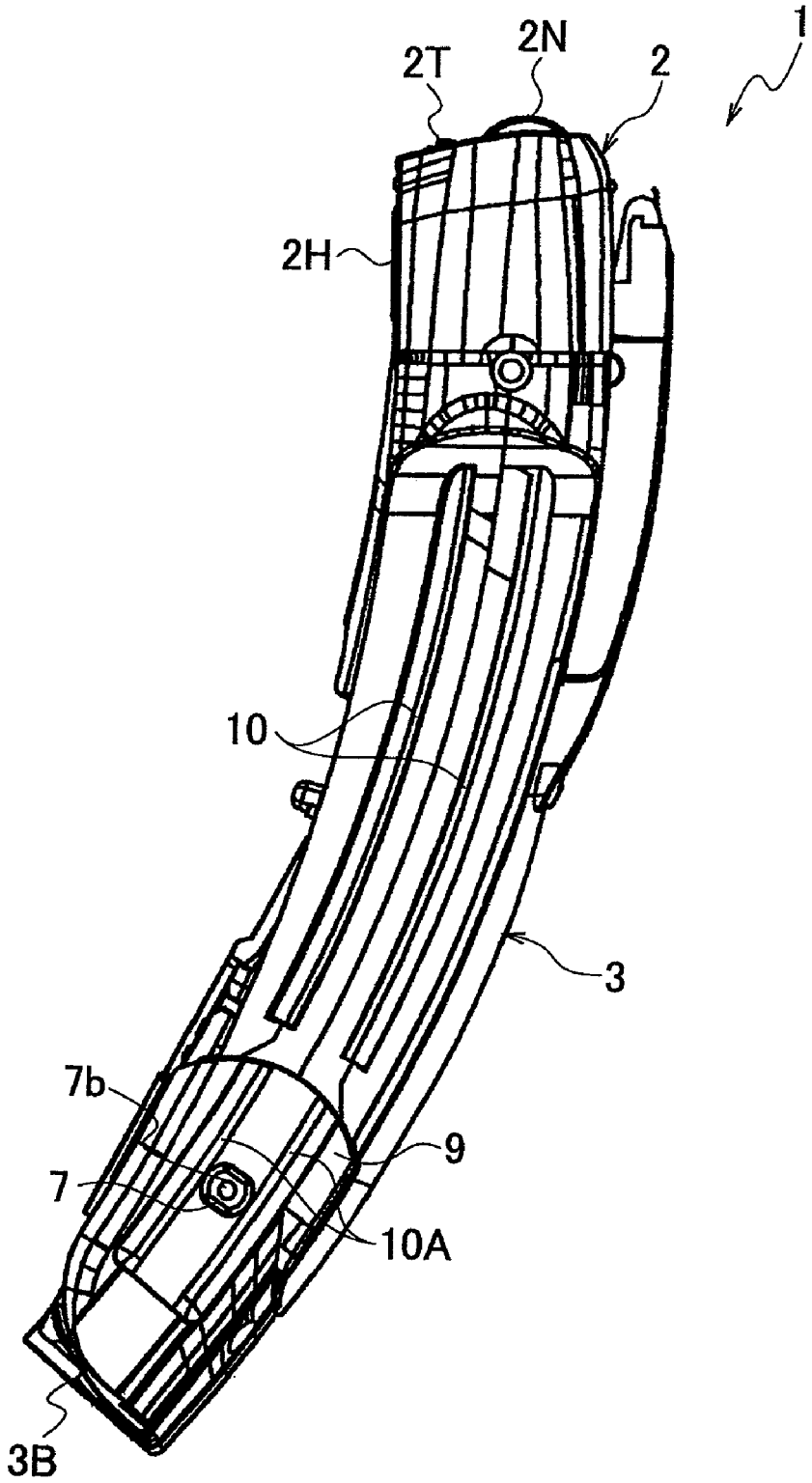
FIG. 5 is a side view of the electric hair remover, with the holder part and front cover removed, according to the embodiment of the present invention.

FIG. 5 is a side view of the electric hair remover, with the holder part and front cover removed.

Figure 6:
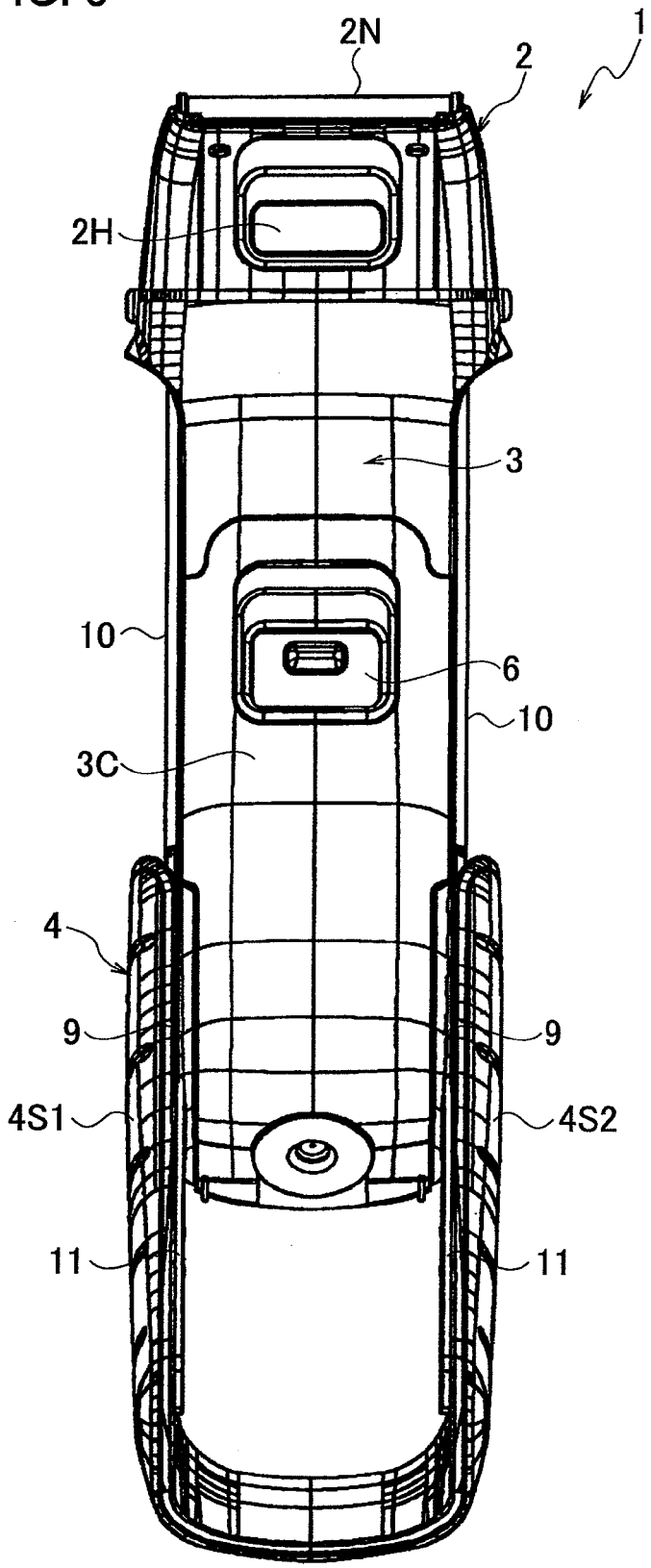
FIG. 6 is a front view of the electric hair remover, with the holder part most pulled out, according to the embodiment of the present invention.

FIG. 6 is a front view of the electric hair remover, with the holder part most pulled out.

Figure 7:
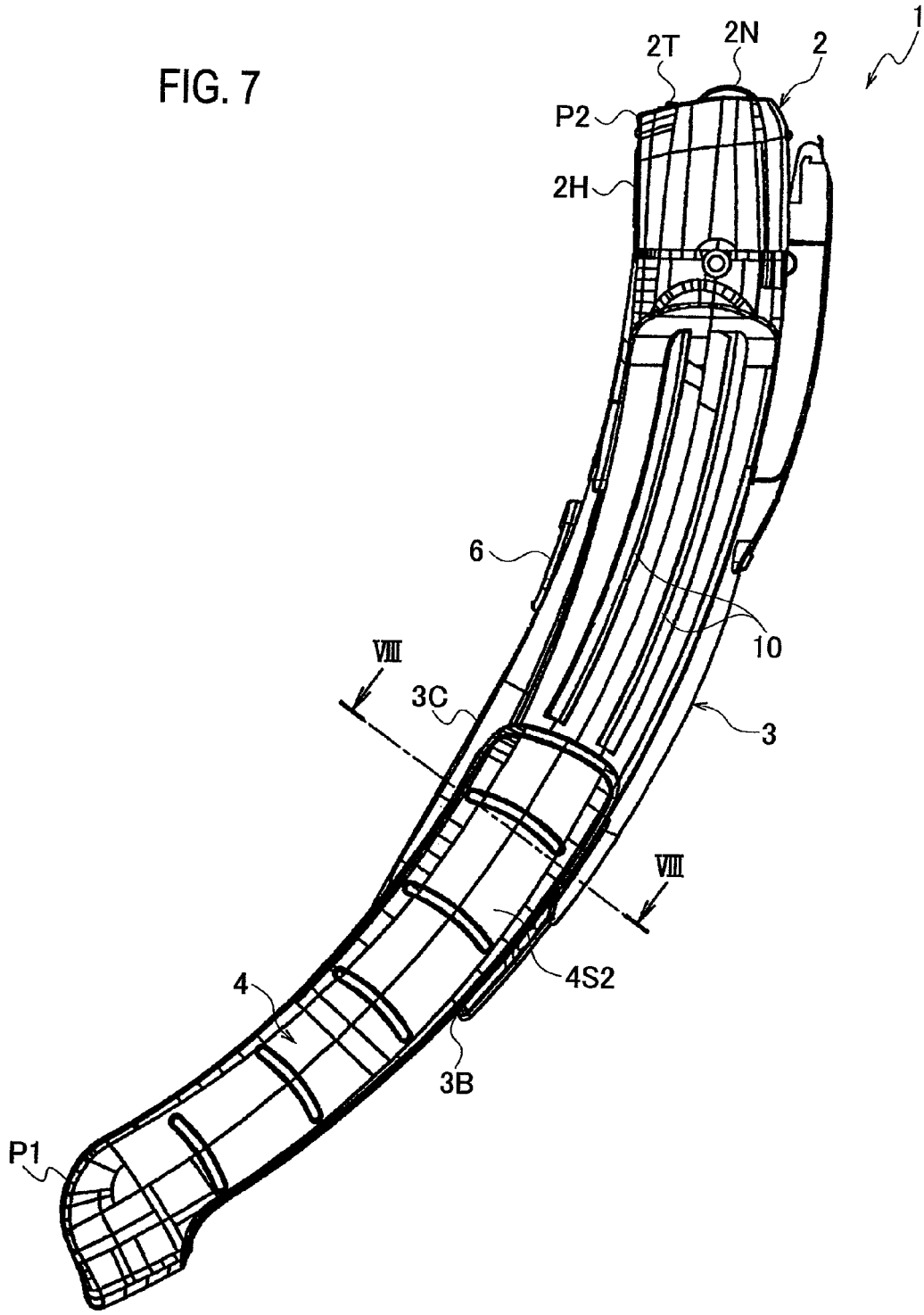
FIG. 7 is a side view of the electric hair remover, with the holder part most pulled out, according to the embodiment of the present invention.

FIG. 7 is a side view of the electric hair remover, with the holder part most pulled out.

Figure 8:
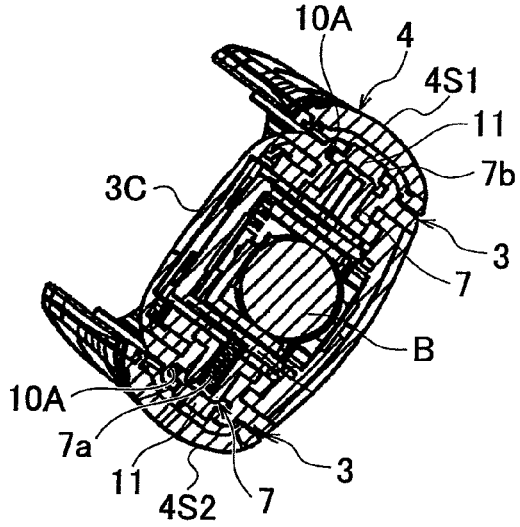
FIG. 8 is a cross sectional view taken along the line VIII-VIII in FIG. 7.

FIG. 8 is a cross sectional view taken along the line VIII-VIII in FIG. 7.

Figure 9:
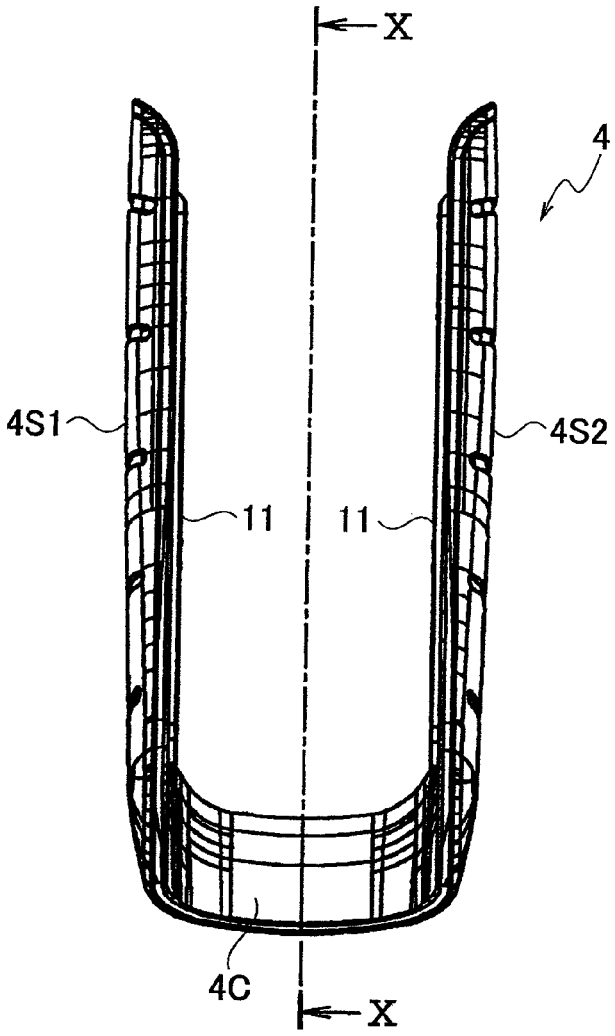
FIG. 9 is a front view of the holder part of the electric hair remover, according to the embodiment of the present invention.

FIG. 9 is a front view of the holder part of the electric hair remover.

Figure 10:
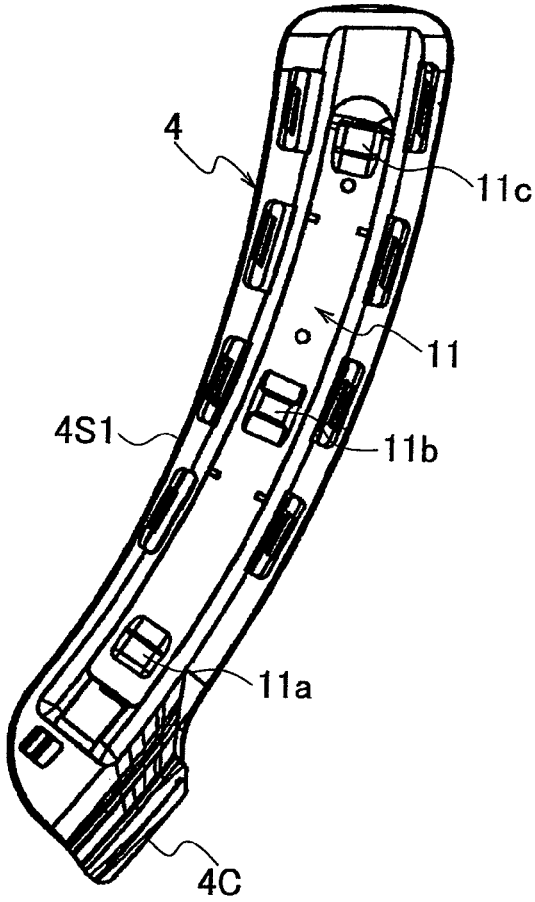
FIG. 10 is a cross sectional view taken along the line X-X in FIG. 9.

FIG. 10 is a cross sectional view taken along the line X-X in FIG. 9.

Figure 11:
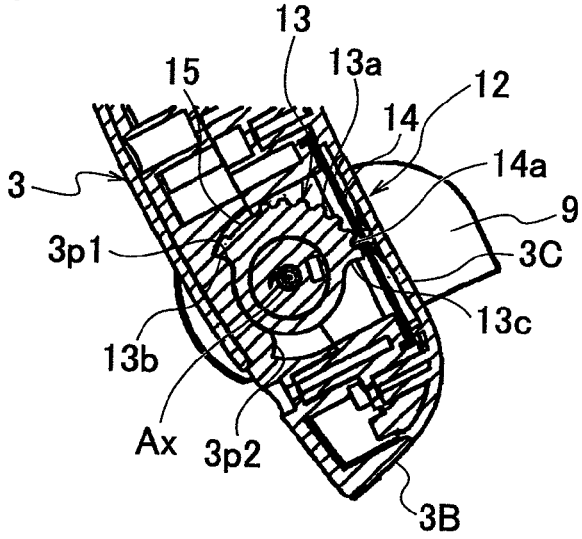
FIG. 11 is a cross sectional view of an angle adjuster of the electric hair remover, according to the embodiment of the present invention.

FIG. 11 is a cross sectional view of an angle adjuster of the electric hair remover.

Figure 12:
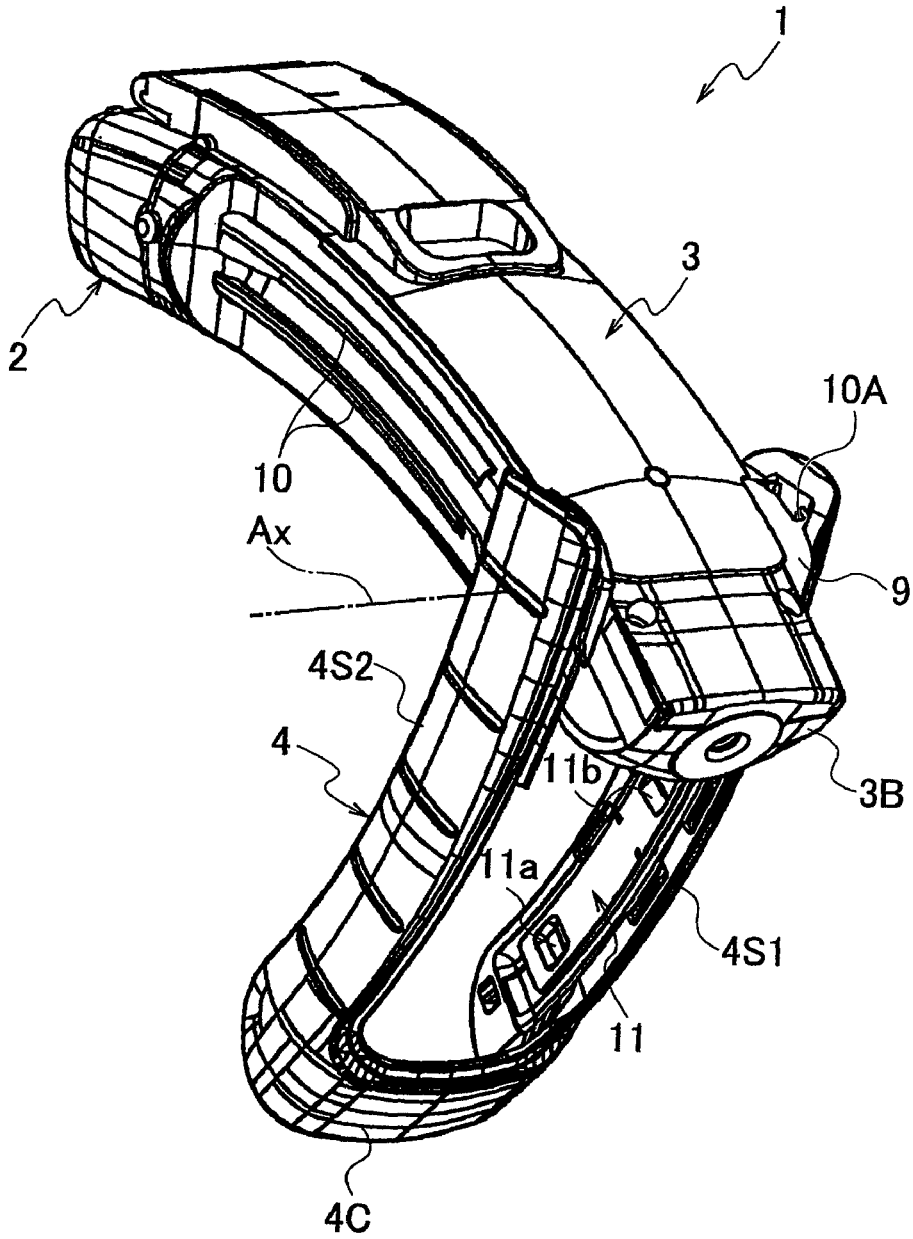
FIG. 12 is a perspective view of the electric hair remover, with the holder part most rotated, according to the embodiment of the present invention.

FIG. 12 is a perspective view of the electric hair remover, with the holder part most rotated.

Figure 13:
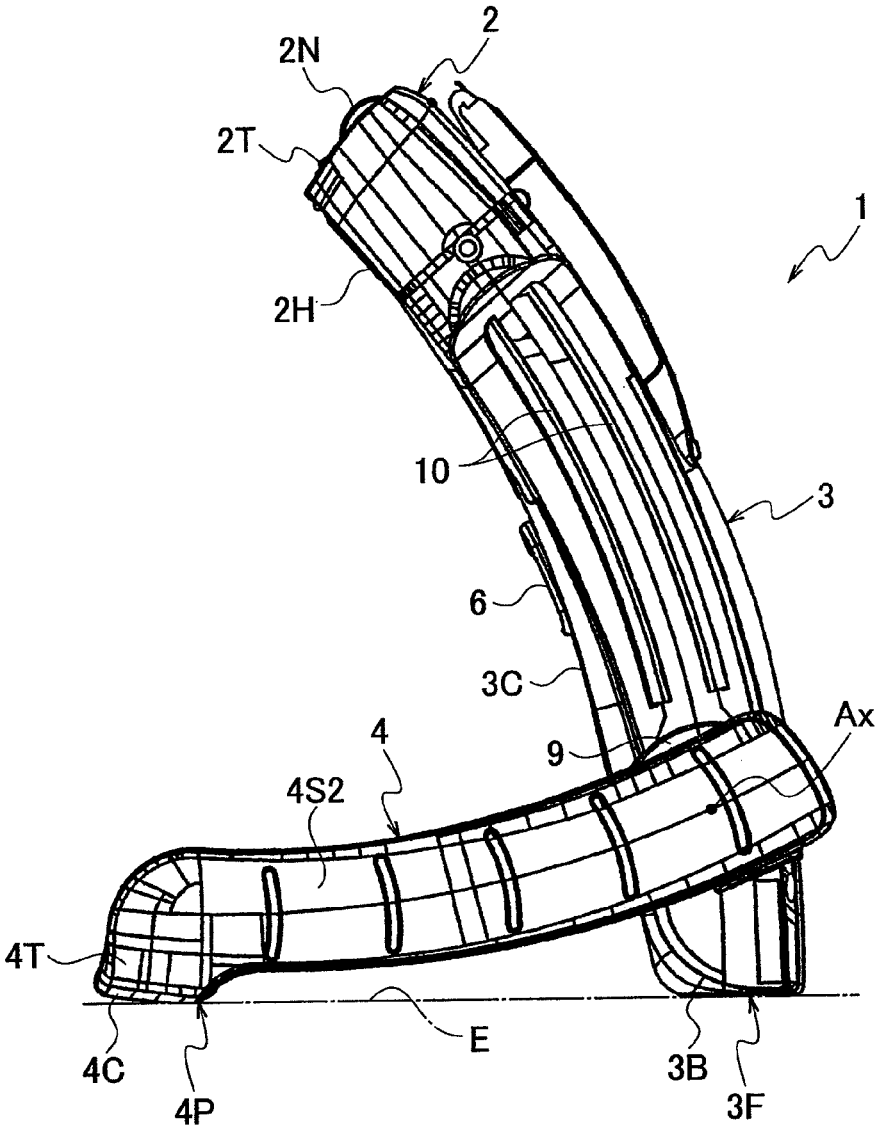
FIG. 13 is a side view of the electric hair remover, with the holder part most rotated, according to the embodiment of the present invention.

FIG. 13 is a side view of the electric hair remover, with the holder part most rotated.

Figure 14:
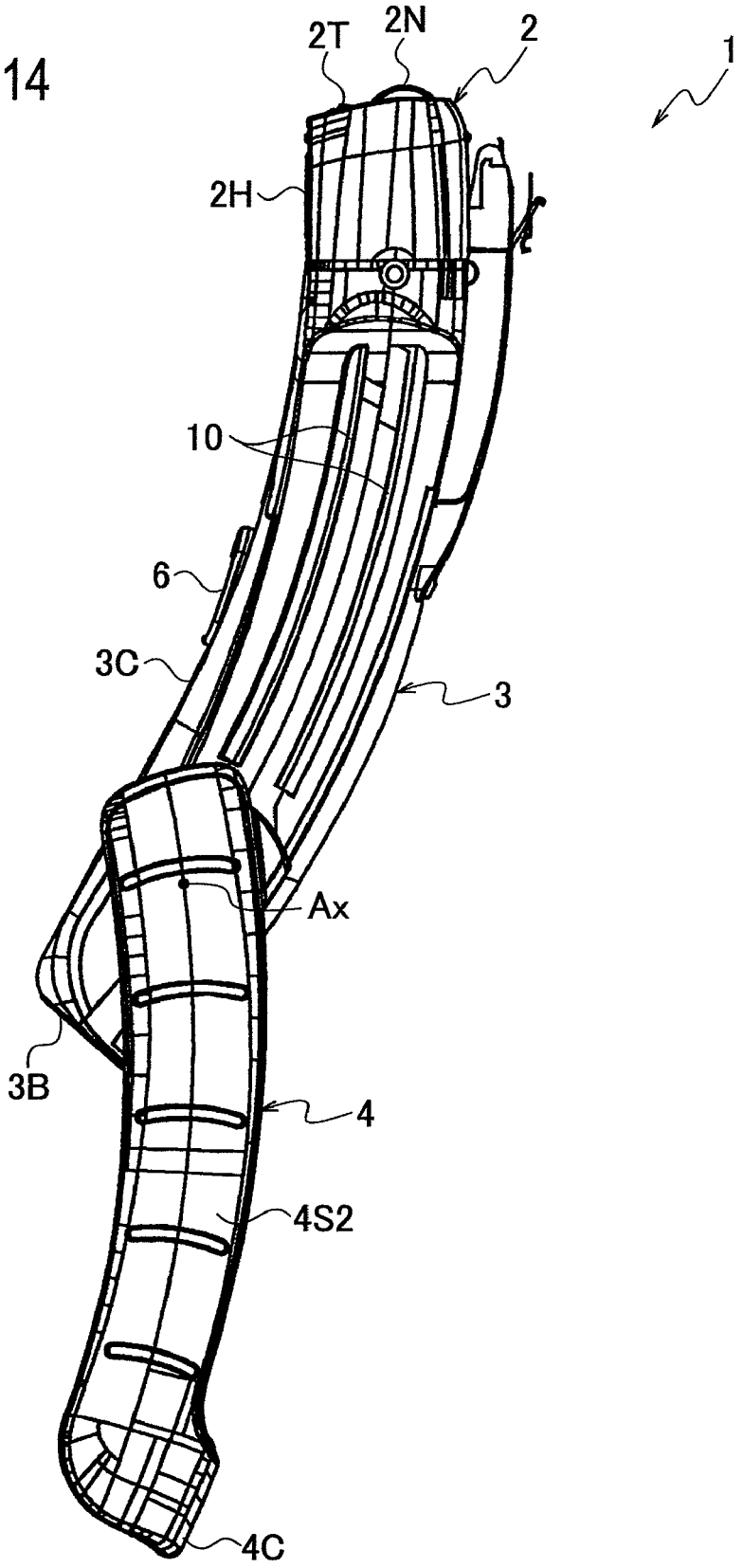
FIG. 14 is a side view showing that a load relief part of the electric hair remover is in operation, according to the embodiment of the present invention.

FIG. 14 is a side view showing that a load relief part of the electric hair remover is in operation.

Figure 15:
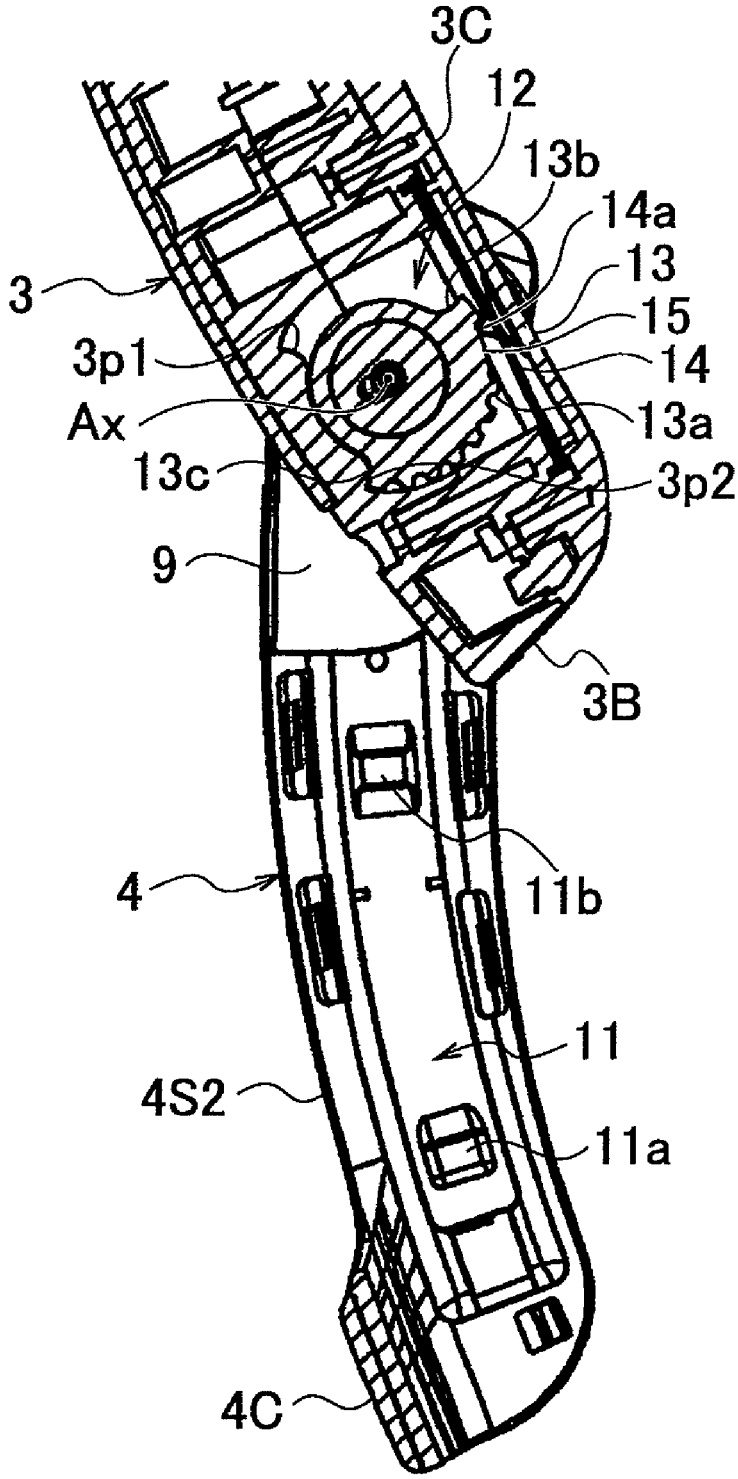
FIG. 15 is a side view of an angle adjuster when the load relief part of the electric hair remover is in operation, according to the embodiment of the present invention.

FIG. 15 is a side view of an angle adjuster when the load relief part of the electric hair remover is in operation.

As shown in FIG. 1 and FIG. 2, an electric hair remover 1 (epilator) according to an embodiment includes a body part 3 having such a structure that a blade block 2 as a blade part for cutting hair is disposed at a head end 3*e* along a longitudinal direction (upper-lower direction in FIG. 1 and FIG. 2).

In the longitudinal direction, the body part 3 is gently curved along an arc having substantially a constant radius, as shown in FIG. 2. According to the curved configuration of the body part 3, portions of a holder part 4 on respective right and left sides of the body part 3 are each curved. Hereinafter, for convenience' sake, a radial inner side of the curved body part 3 is defined as front side while a radial outer side of the body part 3 is defined as back side.

The blade block 2 has a comb-shaped trimmer blade 2T for cutting a long hair and a net blade 2N for finishing the hair shortened by the trimmer blade 2T. The net blade 2N fixedly protrudes at a head end of the blade block 2. Meanwhile, upward-downward operations of a trimmer handle 2H disposed on the front side of the blade block 2 allow the trimmer blade 2T to protrude (upward) from and subside (downward) in the head end of the blade block 2.

As shown in FIG. 3, the body part 3 includes a motor 5 for driving the trimmer blade 2T and net blade 2N. To a head end of the motor 5, a driver 5*b* is mounted via an eccentric cam 5*a* in such a state that the driver 5*b* is eccentric. It is so structured that rotation of the motor 5 is converted into reciprocation of the driver 5*b*. Moreover, the body part 3 includes a battery block B for driving the motor 5.

Moreover, an inner blade 2Na of the net blade 2N is mounted to a head end of the driver 5*b*, and the inner blade 2Na sliding with is configured to cut hair. Furthermore, a trimmer driver 2Ta for transmitting the driving force to the trimmer blade 2T is disposed on the way of the driver 5*b*.

A switch handle 6 is disposed substantially in the center on the front side of the body part 3. Being hooked with a hook (not shown) of a front cover 3C of the body part 3, the switch handle 6 makes reciprocation in the longitudinal direction, thereby switching open-and-close of a circuit for driving the motor 5. As such, the switch handle 6 serves as an operator for switching ons-and-offs (i.e., on-operation and off-operation) of a power source.

In addition, the electric hair remover 1 according to the embodiment has the holder part 4 which is a member separated from the body part 3. The holder part 4 is mounted to the body part 3 in such a configuration as to be telescopically slidable relative to the body part 3 along the longitudinal direction and to make a rotation relative to the body part 3.

As shown in FIG. 9, the holder part 4 includes a left part 4S1, a right part 4S2 and a connector part 4C which are combined to be shaped substantially into an alphabetical U extending along an outer periphery of the body part 3. Hereinabove, the left part 4S1 and right part 4S2 extend on respective left and right sides in the lateral direction of the body part 3 in front view while the connector part 4C connects head end sides (in the pull-out direction) of the respective left and right parts 4S1, 4S2.

As shown in FIG. 4 and FIG. 5, rotation bases 9 each configured to make a rotation around a slide lock button 7 are disposed on both sides of a base part 3B in the lower part of the body part 3.

Moreover, on a sideface of the body part 3, a rail groove 10 is formed for allowing the holder part 4 to slide on the rail groove 10. Meanwhile, the rotation base 9 has a rail groove 10A on an extension of the rail groove 10.

Meanwhile, as shown in FIG. 10, a rail 11 slidably engaged with the rail grooves 10, 10A is formed on an inner face of each of the left and right parts 4S1, 4S2 of the holder part 4, where FIG. 10 shows the left part 4S1.

Inserting the rails 11 into the rail grooves 10, 10A allows the portions of the holder parts 4 to be disposed on both sides of the body part 3, as shown in FIG. 1 and FIG. 2. Then, sliding the rails 11 along the rail grooves 10, 10A allows the holder part 4 to move along the longitudinal direction of the body part 3.

The above accomplishes a structure which allows a combination of the body part 3 and holder part 4 to make a telescopic movement. Hereinabove and hereinafter, FIG. 1 and FIG. 2 show a shrunk state of the combination while FIG. 6 and FIG. 7 show an extended state of the combination.

In addition, as shown in FIG. 10, on the inner side of the rail 11, a plurality of rail dent parts 11*a*, 11*b*, 11*c* each disengageably mated with the slide lock button 7 are disposed at certain intervals in the longitudinal direction.

As shown in FIG. 8, an inner face of the slide lock button 7 is formed with a coil spring 7*a* which is so set as to continuously press (bias) the slide lock button 7 outward.

As such, a head end of the slide lock button 7 is caused to continuously protrude through a hole formed in the rail groove 10A disposed on the rotation base 9.

Then, a head end protrusion part 7*b* of the slide lock button 7 is so configured to be sequentially mated with the rail dent parts 11*a*, 11*b*, 11*c* according to sliding positions of the holder part 4.

In other words, with the body part 3 and holder part 4 most shrunk, the head end protrusion part 7*b* of the slide lock button 7 is brought into such a state as to be mated with the rail dent part 11*a*. In this state, pulling the holder part 4 in the extended direction disengages the head end protrusion part 7*b* from the rail dent part 11*a*, thus allowing the holder part 4 to slide with the head end protrusion part 7*b* pressed in.

Then, when the next rail dent part 11*b* comes to a position of the slide lock button 7 according to the sliding of the holder part 4, the biasing force of the coil spring 7*a* allows the head end protrusion part 7*b* of the slide lock button 7 to protrude and thereby to engage with the rail dent part 11*b*, thus fixing the holder part 4. Likewise, with the holder part 4 most pulled out of the body part 3, the head end protrusion part 7*b* of the slide lock button 7 is mated with the rail dent part 11*c*, thus fixing the holder part 4.

The rail 11 is mated with both of the rail groove 10 on the body part 3 side and the rail groove 10A on the rotation base 9 side. As shown in FIG. 6 and FIG. 7, however, with the body part 3 and holder part 4 most extended (i.e., the holder part 4 most pulled out of the body part 3), that is, when the slide lock button 7 is engaged with the rail dent part 11*c*, the rail 11 is removed from the rail groove 10 and mates only with the rail groove 10A.

As such, the rotation base 9 is allowed to make a rotation only when the body part 3 and holder part 4 are most extended. In this state, as shown in FIG. 12 and FIG. 13, the body part 3 can be so bent relative to the holder part 4 as to form substantially an alphabetical V in combination with the holder part 4. A rotation center brought about in this state is referred to as a rotation axis Ax in FIG. 12 and FIG. 13.

Then, as shown in FIG. 11, the rotation base 9 as a rotation part of the holder part 4 has an angle adjuster 12 for accomplishing multi-step rotational fixations within the rational area of the holder part 4. The angle adjuster 12 includes a click gear 13 and a plate-spring click plate 14, where the click gear 13 is integrally rotatable with the rotation base 9 and has an outer periphery formed with a gear-shaped irregular part 13*a* while the click plate 14 is disposed on the body part 3 side and adds a rotational resistance to the irregular part 13*a* of the click gear 13.

A protrusion part 14*a* engageable with a dent of the irregular part 13*a* of the click gear 13 is formed in substantially the center part of the click plate 14. The protrusion part 14*a* engaged with one of the dents of the irregular part 13*a* can prevent the rotation of the rotation base 9 by means of a certain resistance force.

Then, applying to the rotation base 9 a rotational force having a certain resistance force or over allows the protrusion part 14*a* of the click plate 14 to be pushed out of the dent of the irregular part 13*a* while allowing the rotation of the click gear 13, thus varying the rotation angle (i.e., angle between the body part 3 and the holder part 4) of the holder part 4.

The irregular part 13*a* is formed corresponding to the allowable rotational area of the holder part 4. First and second stepped parts 13*b*, 13*c* formed on respective sides of the irregular part 13*a* of the click gear 13 are configured to abut on respective first and second stopper parts 3*p*1, 3*p*2 formed on the body part 3 side, thus stopping the rotation of the holder part 4 to thereby prevent further rotation of the holder part 4.

Moreover according to the embodiment, the body part 3 is gently curved in the longitudinal direction. As shown in FIG. 11, the angle adjuster 12 of the rotation base 9 has a load relief part 15. The load relief part 15 is so set as to make the following operation:

When the holder part 4 slides in the longitudinal direction of the body part 3 thereby forming an extended state in a curved form in combination with the body part 3, the load relief part 15 relieves, corresponding to a certain load or over applied to the rotation base 9, the body part 3 from the holder part 4 in the direction for opening (see FIG. 14).

In other words, the load relief part 15 is, as shown in FIG. 11, set by cutting away the irregular part 13*a* of the click gear 13 in a certain range. That is, in the following range, the load relief part 15 is formed by cutting away the irregular part 13*a* which corresponds to the protrusion part 14*a* of the click plate 14:

From a first state that the holder part 4 is extended (see FIG. 7) to a second state that the holder part 4 is rotated in the opening direction (see FIG. 14).

The above structure accomplishes the following operation:

After the protrusion part 14*a* of the click plate 14 goes over the protrusion of the irregular part 13*a* (which has the dent engageable with the protrusion part 14*a*) with the holder part 4 ordinarily extended, the holder part 4 is made free. Then, as shown in FIG. 15, the holder part 4 is allowed to be bent without resistance until the second stepped part 13*c* of the click gear 13 abuts on the second body part 3*p*2.

When the body part 3 and holder part 4 are most extended to form substantially an arch, i.e., when the electric hair remover 1 is disposed on a flat face (such as upper face of a shelf) as a pedestal such that the left side (in FIG. 7) of the electric hair remover 1 is disposed downward, a sudden load which may be applied leftward in FIG. 7 to the center part of the arch is entirely received by a first head end P1 of the holder part 4 and a second head end P2 of the blade block 2.

According to the embodiment, the load relief part 15 provided for the rotation base 9 works to allow the body part 3 and holder part 4 to open in a form of a reversed bending, as shown in FIG. 14. As such, an edge part of the base part 3B of the body part 3 contacts the flat base and thereby can receive the load.

Moreover according to the embodiment, as shown in FIG. 13, a substantially flat mounting face 3F is formed on a surface of the base part 3B. In the longitudinal direction, the base part 3B is disposed on a side opposite to a side of the head end part (for providing the blade block 2) of the body part 3.

With the holder part 4 rotated, a single point of a part (the head end part 4T according to the embodiment) spaced apart from the rotation axis Ax of the holder part 4 is disposed on an extended face E along the mounting face 3F. The single point is defined as a contact part 4P.

In addition, according to the embodiment, with the body part 3 and holder part 4 most rotated, the head end part 4T of the holder part 4 is disposed on the extended face E of the mounting face 3F.

With this, for such a case as to remove unwanted hair on the back and the like with the electric hair remover 1, the electric hair remover 1 can be disposed in such a state that the holder part 4 is most rotated for use while the body part 3 is standing on the flat face as the pedestal.

Herein, as shown in FIG. 9, the holder part 4 having the left and right parts 4S1, 4S2 and the connector part 4C is formed substantially into an alphabetical U. With the above configuration, pulling the holder part 4 out of the body part 3 allows the thus pulled-out part of the holder part 4 to be kept hooked with a hook and the like (not shown).

In a shower room and the like, the user, as the case may be, removes hair in a standing state. In such a case, for checking the finished state after clearing (or dusting) off the hair which was adhered to the body, the user is supposed to once release the electric hair remover 1 from hand. In this case, hooking the pulled-out holder part 4 (set forth above) with a protrusion such as hook can rapidly restart the hair-removing operation without leaving the electric hair remover 1 on the floor or the like.

As set forth above, with the electric hair remover 1 according to the embodiment, the holder part 4 which is a member separated from the body part 3 is telescopically slidable relative to the body part 3 in the longitudinal direction and rotatable relative to the body part 3.

As such, when the user abuts the blade block 2 on skin, length or angle of the body part 3 in combination with the holder part 4 can be conveniently changed, thus improving usability of the electric hair remover 1.

As such, the blade block 2 at the head end of the electric hair remover 1 of the present invention can easily abut on tiptoes, calf, back and the like on which the conventional fixed-type counterpart fails to easily abut. Especially, rotating the holder part 4 in its elongated state allows the blade block 2 to abut on a portion far away from hand, such as back.

Moreover according to the embodiment, it is so structured that the holder part 4's rotation relative to the body part 3 is allowed only when the combination of the body part 3 and the holder part 4 is most elongated.

As such, with the blade block 2 spaced apart from the holder part 4, the holder part 4's angle relative to the body part 3 can be set variable. During operation of removing hair, the above structure of the electric hair remover 1 allows the blade block 2 to abut on the user's back and the like which is a portion far away from hand.

Moreover, the above structure of the electric hair remover 1 can prevent such a failure that the holder part 4 is moved relative to the body part 3 when the electric hair remover 1 is being used by the user, which is an advantage.

Moreover according to the embodiment, the angle adjuster 12 is capable of engaging the body part 3 with the holder part 4 for fixation at multi-step angles.

As such, the relative angles can be set variable at multiple steps, thus more improving usability of the electric hair remover 1.

That is, according to physique and body flexibility and the like of the user, the electric hair remover 1 can be set more usable and convenient.

Moreover according to the embodiment, the load is applied to the body part 3 and holder part 4 in the direction of relative rotation, thereby elastically deforming at least a part (click plate 14) between the rotation axis Ax (of the relative rotation) and the mutual engagement part. As such, the engagement state by means of the angle adjuster 12 can be disengaged in the direction for opening the body part 3 relative to the holder part 4.

As such, a possible breakage of the part mutually engaged by means of the angle adjuster 12 can be prevented, which breakage is attributable to the above applied load.

Especially according to the embodiment, the combination of the body part 3 and holder part 4 is curved along the longitudinal direction to form substantially an arch and the load relief part 15 set at the rotation base 9 disposed substantially in the center part of the longitudinal direction works for allowing a reversed-bending relative rotation between the body part 3 and the holder part 4.

As such, a possible breakage of the body part 3 or holder part 4 can be prevented, which breakage is attributable to a sudden load applied to the center part.

Moreover according to the embodiment, the substantially flat mounting face 3F is formed on the surface of the base part 3B, as shown in FIG. 13. In the longitudinal direction, the base part 3B is disposed on the side opposite to the side of the head end part 3*e* of the body part 3.

In addition according to the embodiment, with the body part 3 and holder part 4 rotated relative to each other by a certain angle, a surface of a part (the head end part 4T of the holder part 4, according to the embodiment) which is spaced apart from the rotation axis Ax is disposed on the extended face E along the mounting face 3F. The surface of the above part is defined as a contact part 4P.

The mounting face 3F and contact part 4P are caused to have a contact with a flat face as a pedestal, and thereby the body part 3 is allowed to stand on the flat face, with the blade block 2 positioned upper.

As such, with the body part 3 and holder part 4 bent relative to each other, the electric hair remover 1 can be disposed on the flat face, thus further improving usability of the electric hair remover 1.

Moreover according to the embodiment, the holder part 4 includes the left part 4S1, right part 4S2 and connector part 4C which are combined to be shaped substantially into an alphabetical U extending along an outer periphery of the body part 3. Hereinabove, the left part 4S1 and right part 4S2 are disposed on respective left and right sides in the lateral direction of the body part 3 substantially perpendicular to the longitudinal direction of the body part 3 while the connector part 4C connects head end sides (in the pull-out direction) of the respective left and right parts 4S1, 4S2.

As such, the holder part 4's U-shaped part can be used as a hook, thus further improving usability of the electric hair remover 1.

Although the embodiment of the present invention has been described above, the present invention is not limited to the above embodiment. Modifications and variations of the embodiment described above will occur to those skilled in the art, in light of the above teachings.

For example, configuration, position and the like of each of the mounting face 3F and the contact part 4P may be properly changed.

Furthermore, the trimmer blade 2T and net blade 2N are disposed at the blade block 2, but not limited thereto. A single blade or other blade(s) may be provided for the blade block 2.

This application is based on a prior Japanese Patent Application No. P2007-332622 (filed Dec. 25, 2007 in Japan). The entire contents of the Japanese Patent Application No. P2007-332622 from which priority is claimed are incorporated herein by reference, in order to take some protection against translation errors or omitted portions.

The scope of the present invention is defined with reference to the following claims.

What is claimed is:

1. An electric hair remover, comprising:

a body part having a head end part in a longitudinal direction, a blade part for cutting hair being formed at the head end part;

a holder part mounted to the body part in such a configuration as to make a sliding operation along the longitudinal direction of the body part and to make a rotating operation; and an angle adjuster configured to engage both the body part and the holder part in a multi-step engagement so as to fix the body part and holder part at respective angles, wherein, the angle adjuster includes:

a click gear having a gear-shaped irregular part formed on an outer periphery of the click gear, a click plate having a protrusion part engageable with a dent of the irregular part, a load relief part provided at an outer periphery of the click gear within a range corresponding to a first state in which the holder part is extended to a second state in which the holder part is rotated in an opening direction that opens the body part and the holder part relative to each other, and the load relief part defined by an absence of the irregular part on an outer periphery of the click gear within the range.

2. The electric hair remover according to claim 1, wherein the holder part is allowed to rotate relative to the body part only when a combination of the body part and the holder part is substantially most extended.

3. The electric hair remover according to claim 1, wherein when a load is applied to the body part and the holder part in a direction of the rotation relative to each other, the click plate is elastically deformed and an engagement state of the angle adjuster is disengaged in the opening direction for opening the body and the holder part relative to each other.

4. The electric hair remover according to claim 3, wherein the combination of the body part and the holder part is curved along the longitudinal direction to form substantially an arch, and the load relief part is set at a rotation base disposed substantially in a center part of the arch in the longitudinal direction, and the load relief part is configured to allow the body part and the holder part to be rotatably opened relative to each other to such an extent as to be folded in a reverse direction.

5. The electric hair remover according to claim 1, wherein a substantially flat mounting face is formed on a surface of a base part which is disposed, in the longitudinal direction, on a side opposite to a side of the head end part of the body part, with the body part and the holder part rotated relative to each other by a certain angle, a surface of a head end part of the holder part is disposed in a certain position along the mounting face, to thereby form a contact part, where the head end part is spaced apart from a rotation axis of the holder part, and the mounting face and the contact part are configured to contact a flat face of a pedestal so as to allow the body part to stand on the flat face of the pedestal.

6. The electric hair remover according to claim 1, wherein the holder part includes:

a first part, a second part and a connector part which are combined to be shaped substantially into an alphabetical U extending along an outer periphery of the body part, and the first part and the second part are disposed on respective first and second sides in a lateral direction of the body part substantially perpendicular to the longitudinal direction of the body part while the connector part connects head end sides of the respective first and second parts, the head end sides being disposed in a pull-out direction.

7. The electric hair remover according to claim 1, wherein a rail of the holder part is simultaneously engageable with both a first rail groove on the body part and a second rail groove on a rotation base which is configured to rotate relative to the body part.

8. The electric hair remover according to claim 7, wherein the rail of the holder part is configured to slide longitudinally to disengage the first rail groove and mate only with the second rail groove, allowing the rotation base to rotate relative to the body part.

* * * * *